US005227805A

United States Patent [19]

King et al.

[11] Patent Number: 5,227,805

[45] Date of Patent: Jul. 13, 1993

[54] ANTENNA LOOP/BATTERY SPRING

[75] Inventors: Jeffrey S. King, Boynton Beach; Lorenzo P. DeLeon, Lake Worth, both of Fla.

[73] Assignee: Motorola, Inc., Schaumburg, Ill.

[21] Appl. No.: 426,915

[22] Filed: Oct. 26, 1989

[51] Int. Cl.[5] ..... H01Q 1/24

[52] U.S. Cl. ..... 343/702; 343/741; 343/720

[58] Field of Search ..... 343/702, 741, 720, 866; 320/2; 455/89, 90, 343

[56] References Cited

U.S. PATENT DOCUMENTS

| | | | |
|---|---|---|---|
| 3,736,591 | 5/1973 | Rennels et al. | 343/702 |
| 3,852,756 | 12/1974 | Reese | 343/895 |
| 4,590,614 | 5/1986 | Erat | 343/702 |
| 4,591,863 | 5/1986 | Patsiokas | 343/702 |
| 4,814,776 | 3/1989 | Caci et al. | 343/748 |
| 4,864,636 | 9/1989 | Brunius | 343/702 |
| 4,903,326 | 2/1990 | Zakman et al. | 343/702 |
| 4,920,353 | 4/1990 | Mori et al. | 343/702 |

FOREIGN PATENT DOCUMENTS

| | | | |
|---|---|---|---|
| 63-168175 | 7/1988 | Japan | 343/702 |

*Primary Examiner*—Rolf Hille
*Assistant Examiner*—Hoanganh Le
*Attorney, Agent, or Firm*—Daniel R. Collopy; William E. Koch; Thomas G. Berry

[57] ABSTRACT

An electromechanical assembly for use in a portable communications device including an antenna loop and a coil spring coupled to the antenna loop for making electrical contact with one terminal of a battery and for supplying a bias for physically holding the battery substantially immobile, wherein the coil spring and the antenna loop are formed of a continuous piece of material.

10 Claims, 2 Drawing Sheets

ANTENNA LOOP/BATTERY SPRING

The present invention pertains to an electromechanical assembly constructed to reduce the part count in a portable communication device and more specifically to a portion of an antenna loop and a battery spring formed as an integral unit, and methods of manufacture and use.

BACKGROUND OF THE INVENTION

In communication devices, two commonly found elements are loop antennas and battery springs. These elements are always constructed separately, requiring special procedures for each element. Also, each element requires a separate procedure for assembling into the communication device. Thus, these elements are relatively expensive because of the number of steps required to manufacture and assemble each element and the space required by the elements is excessive.

SUMMARY OF THE INVENTION

It is an object of the present invention to provide a new and improved electromechanical assembly for use in portable communication devices.

It is a further object of the present invention to provide a battery spring and antenna loop combination.

It is a further object of the present invention to provide a battery spring and antenna loop combination and methods of manufacture and use which reduce the number of steps in the manufacturing and assembly procedures and which requires a reduced amount of space in the communication device.

It is a further object of the present invention to provide an improved electromechanical assembly wherein a battery is used as at least a portion of a loop antenna.

One aspect of the present invention comprises an electromechanical assembly for use in a portable communication device including at least one antenna loop and a coil spring coupled to the antenna loop for making electrical contact with one terminal of a battery and for supplying a bias for physically holding the battery substantially immobile, wherein the coil spring and the antenna loop are formed of a continuous piece of material.

Another aspect of the present invention is a method of manufacturing an electromechanical assembly including at least one loop antenna and a battery coil spring. The method comprises the steps of providing an elongated piece of electrically conducting material sufficiently long to form the loop antenna and the battery coil spring, and bending the material to form the loop antenna and the battery coil spring attached to part of the loop antenna. Another aspect of the present invention is a method of assembling a loop antenna and a battery spring into a communication device. The method comprises the steps of providing an electromechanical assembly including at least one antenna loop and a coil spring coupled to the antenna loop for making electrical contact with one terminal of a battery and for supplying a bias for physically holding the battery substantially immobile, providing a printed circuit board with at least two openings therethrough positioned to receive at least two projections of said electromechanical assembly, positioning the at least two projections of the electromechanical assembly in the at least two openings of the printed circuit board, and soldering the at least two projections to the printed circuit board.

Another aspect of the present invention is a loop antenna for use in a portable communication device. The loop antenna consists of two battery springs mounted to a substrate and a battery electrically and mechanically connected therebetween.

BRIEF DESCRIPTION OF THE DRAWINGS

Referring to the drawings.

DESCRIPTION OF THE PREFERRED EMBODIMENTS

Figure 1:
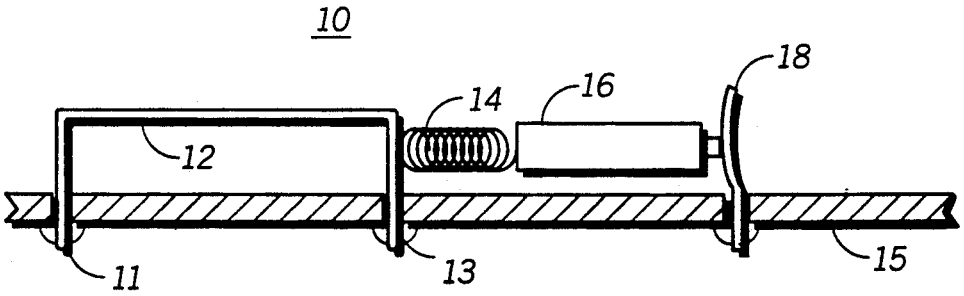
FIG. 1 is a sectional view of a printed circuit board having a battery spring and loop antenna, formed in accordance with the present invention, mounted thereon.

Referring specifically to FIG. 1, an electromechanical assembly 10 is illustrated including a loop antenna 12 and a battery spring 14. While loop antenna 12 is illustrated as including only a single loop, it will be understood by those skilled in the art that several different loops might be included in loop 12 and/or several different loops might be attached to loop 12 for operation in different applications. Also, as is well understood in the art, battery spring 14 provides an electrical contact to one end of a battery 16 while supplying a mechanical bias at the one end which urges battery 16 against a second spring contact 18, thereby, physically holding battery 16 immobile. In this specific embodiment, loop antenna 12 is formed with mounting projections 11 and 13 at either end thereof, which projections 11 and 13 are received in openings in a printed circuit board 15 and affixed to printed circuit board 15 by solder or the like for rigidly mounting loop antenna 12. One projection (13 in this embodiment) of loop antenna 12 can be grounded to ground the negative pole of battery 16 through battery spring 14. Spring contact 18 is the positive voltage supply contact for the communication device.

In the embodiment of FIG. 1, antenna loop 12 is formed of one or more wires, and a portion of the wire or wires is formed into battery spring 14. Thus, antenna loop 12 and battery spring 14 are formed as an integral unit, preferably in a single manufacturing operation. It will be understood by those skilled in the art, that battery spring 14 could be formed separately from antenna loop 12 and attached in a later step, prior to assembly into a communication device, to form an integral unit. However, this manufacturing technique requires an additional step and, therefore, is not the preferred method. In either embodiment, the electromechanical assembly can be installed in a communication device with one assembly step and the integral unit will save space.

Figure 2:
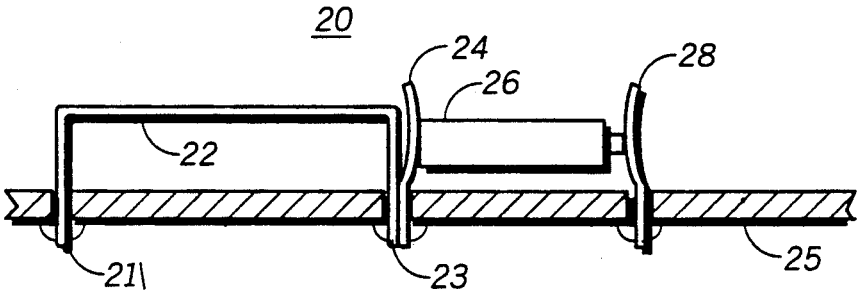
FIGS. 2, 3 and 4 are views similar to FIG. 1 of other embodiments of the present invention.

In the embodiment of FIG. 2, an electromechanical assembly 20 includes a strip antenna 22 formed integrally with a leaf spring type battery contact 24. In this embodiment flat stock of an electrically conducting spring material is utilized in a continuous piece to form strip antenna 22 and leaf spring 24. Mounting projections 21 and 23 are provided and utilized to rigidly mount electromechanical assembly 20 onto a printed circuit board 25. A battery 26 is held immovable between leaf spring 24 and another leaf spring 28, which acts as the positive power supply terminal for the communications device. While strip antenna 22 is illustrated as a vertical loop similar to antenna loop 12, it will be understood that it could be constructed in a variety of configurations and the present drawing is only for convenience of illustration.

Figure 3:
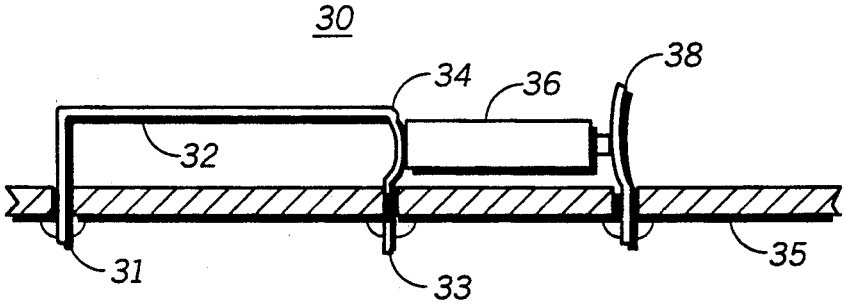

In the embodiment of FIG. 3, an electromechanical assembly 30 includes a strip antenna 32 mounted on a printed circuit board 35 by means of mounting projections 31 and 33 with one vertical side thereof deformed slightly to provide an electrical contact and battery spring 34. In this specific embodiment the formation of battery spring 34 is somewhat simplified and may reduce manufacturing time and cost even further. However, the flexing of strip antenna 32 to accept a battery 36 into physical contact therewith may alter the electrical characteristics of strip antenna 32. Thus, it will probably be necessary to do any adjusting or tuning of the communications device with battery 36 installed.

Figure 4:
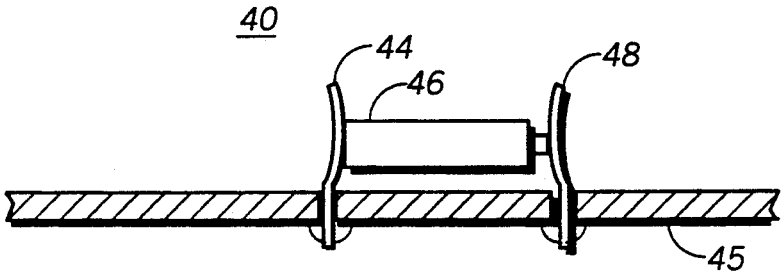

In the embodiment of FIG. 4, a pair of battery springs 4 and 48 are mounted on a printed circuit board 45 in spaced apart relationship with a battery 46 electrically and mechanically engaged therebetween. In this embodiment battery 46 forms the major portion of a loop antenna. "AAA" alkaline-manganese dioxide batteries have been used as a loop antenna and, generally, they are somewhat better than an equivalent length of printed runner (0.020" wide) on FR-4 PCB and somewhat worse than an equivalent length of 0.040" diameter tin-plated stock wire when used as a VHF antenna in the 120 to 140 MHz range. It should be noted that the battery in any of the embodiments illustrated in FIGS. 1–3 could be used as a portion of the loop antenna by simply leaving projections 13, 23, or 33, respectively, electrically unconnected. Thus, the projection 13, 23, or 33 would simply be a mechanical mounting structure for supporting the loop antenna and the battery spring.

Figure 5:
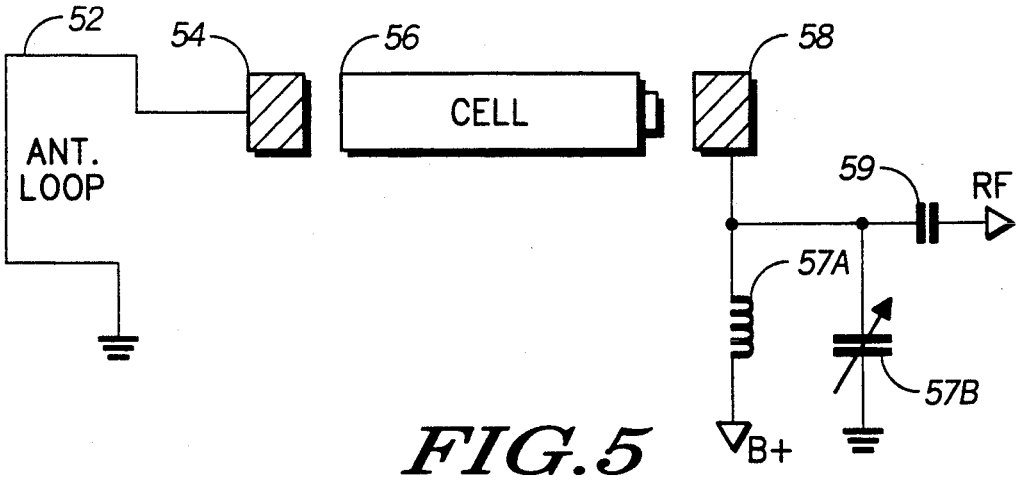
FIGS. 5, 6 and 7 are block/schematic views of the structures illustrated in FIGS. 1 through 4.

Referring to FIG. 5, a block/schematic diagram is illustrated utilizing an electromechanical assembly similar to the structure of FIGS. 1, 2, or 3 with the projection 13, 23, or 33, respectively, electrically unconnected. An antenna loop 52 is grounded at one end and connected at the other end, by means of a battery connection 54, to the negative pole of a battery 56. A second battery connection 58 cooperates with battery connection 54 to hold battery 56 physically immobile and to electrically connect the battery into the circuit. Battery connection 58 is connected to the positive pole of battery 56 and supplies B+ to the communications device (not shown) through an RF choke 57A. RF signals are coupled to the communications device by a coupling/DC blocking capacitor 59. The B+ line is bypassed to ground and the antenna configuration is tuned by a variable capacitor 57B connected from battery connection 58 to ground. Thus, B+ is coupled to the communication device by RF choke 57A, which blocks the RF signals, and the RF signals are coupled to the communication device by capacitor 59, which blocks B+.

Figure 6:
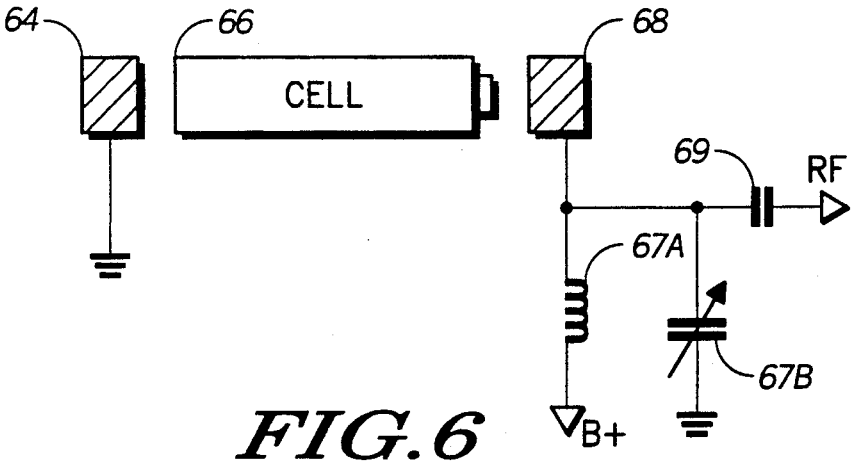

Referring to FIG. 6, a block/schematic diagram is illustrated utilizing an electromechanical assembly similar to the structure of FIG. 4. In this embodiment battery 66 forms the major portion of the loop antenna and is electrically and physically connected into the circuit by battery connections 64 and 68. Battery connection 64 is engaged with the negative pole of battery 66 and is electrically connected to ground. Battery connection 68 is engaged with the positive pole of battery 66 and, through an RF choke 67A, supplies B+ to the communication device (not shown). RF signals are supplied from battery connection 68 to the communication device by an RF coupling/DC blocking capacitor 69. The antenna configuration is tuned by a variable capacitor 67B, which also acts to bypass B+ to ground.

Figure 7:
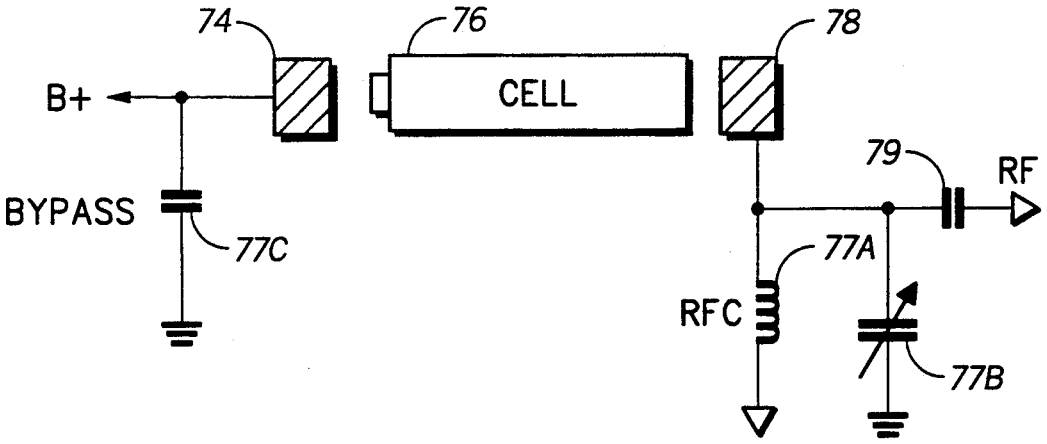

Referring to FIG. 7, a block/schematic diagram is illustrated similar to the embodiment of FIG. 6, except that battery 76 is reversed. Two battery connections 74 and 78 are utilized to electrically and physically connect battery 76 into the circuit. Battery connection 74 is engaged with the positive pole of battery 76 and supplies B+ directly to the communications device (not shown). A bypass capacitor 77C is connected between battery connection 74 and ground to provide a bypass for B+. An RF choke 77A and variable capacitor 77B are connected between battery connection 78 and ground to tune the antenna configuration. The RF signals are supplied from battery connection 78 to the communication device by a coupling capacitor 79.

Thus, several different embodiments of electronic apparatus are illustrated and described wherein an electromechanical assembly is utilized to reduce cost and space. In each of the embodiments at least one antenna loop is combined with a battery spring in such a way that manufacturing steps and costs are reduced and, further, in such a way that assembly steps and costs are reduced. Also, in some of the embodiments material is reduced, as for example by using the battery as an antenna loop, to further reduce cost, size and weight of the final product.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. An electromechanical assembly for use in a portable communication device comprising:

at least one antenna loop; and a coil spring coupled to the antenna loop for making electrical contact with one terminal of a battery and for supplying a bias for physically holding the battery substantially immobile, wherein the coil spring and the antenna loop are formed of a continuous piece of material.

2. An electromechanical assembly as claimed in claim 1 wherein the antenna loop and coil spring are formed of a continuous piece of wire.

3. An electromechanical assembly as claimed in claim 1 wherein the antenna loop and coil spring are formed of a continuous piece of flat stock.

4. An electromechanical assembly as claimed in claim 1 including in addition a battery positioned in electrical contact with the spring and electrically forming at least a portion of the antenna loop.

5. An electromechanical assembly as claimed in claim 4 wherein the battery is an alkaline-manganese dioxide battery.

6. A method of manufacturing an electromechanical assembly including at least one loop antenna and a battery coil spring comprising the steps of:

providing an elongated piece of electrically conducting material sufficiently long to form the loop antenna and the battery coil spring; and bending the material to form the loop antenna and the battery coil spring attached to part of the loop antenna.

7. A method as claimed in claim 6 wherein the step of providing the material includes providing a piece of wire.

8. A method as claimed in claim 6 wherein the step of providing the material includes providing a continuous piece of flat stock.

9. A method of assembling a loop antenna and a battery spring into a communication device comprising the steps of:

providing an electromechanical assembly including at least one antenna loop and a coil spring coupled to the antenna loop for making electrical contact with one terminal of a battery and for supplying a bias for physically holding the battery substantially immobile;

providing a printed circuit board with at least two openings therethrough positioned to receive at least two projections of said electromechanical assembly;

positioning the at least two projections of the electromechanical assembly in the at least two openings of the printed circuit board; and soldering the at least two projections to the printed circuit board.

10. A loop antenna for use in a portable communication device, the loop antenna consisting of two battery springs mounted to a substrate and having a battery electrically and mechanically connected therebetween.

* * * * *